United States Patent [19]

Suefuji et al.

[11] Patent Number: 5,037,279

[45] Date of Patent: Aug. 6, 1991

[54] SCROLL FLUID MACHINE HAVING WRAP START PORTION WITH THICK BASE AND THIN TIP

[75] Inventors: Kazutaka Suefuji; Masao Shiibayashi; Tetsuya Arata, all of Shimizu; Yoshiro Ibaraki, Tsukuba; Jyoji Okamoto, Shizuoka, all of Japan

[73] Assignee: Hitachi, Ltd., Tokyo, Japan

[21] Appl. No.: 409,588

[22] Filed: Sep. 15, 1989

[30] Foreign Application Priority Data

Sep. 19, 1988 [JP] Japan ..... 63-232465

[51] Int. Cl.[5] ..... F01C 1/04

[52] U.S. Cl. ..... 418/55.2; 418/150

[58] Field of Search ..... 418/55 A, 150, 55.2

[56] References Cited

U.S. PATENT DOCUMENTS 4,594,061 6/1986 Terauchi ..... 418/55 A
4,666,380 5/1987 Hirano et al. ..... 418/55 A
4,678,415 7/1987 Hirano et al. ..... 418/55 A

FOREIGN PATENT DOCUMENTS 57-195801 12/1982 Japan .
59-79090 5/1984 Japan ..... 418/55 A
60-252187 12/1985 Japan .

*Primary Examiner*—John J. Vrablik
*Attorney, Agent, or Firm*—Antonelli, Terry, Stout & Kraus

[57] ABSTRACT

A scroll fluid machine in which a stationary scroll member and an orbiting scroll member each have an end plate and involute wrap on said end plate and mesh with each other. A winding-start portion of the wrap has such a section such that a base thereof is thick and the tip thereof is thin, with a curve of an inside line at each of the bases of the wraps is made as thick as possible while avoiding mutual interference between the wrap of fixed scroll member and the wrap of orbiting scroll member. A curve of an inside line at each of tips of the wraps has such a shape that it gradually thinned toward an inner periphery end thereof, and a section of each wraps in the wrap axial direction has such a shape that it is gradually reduced in thickness from the base toward the tip.

4 Claims, 4 Drawing Sheets

SCROLL FLUID MACHINE HAVING WRAP START PORTION WITH THICK BASE AND THIN TIP

BACKGROUND OF THE INVENTION

The present invention relates to a scroll fluid machine and, more particularly, to a scroll compressor for air conditioning.

A so-called bulbous wrap has been conventionally used in which the winding-start portion, that is, the inner peripheral end of the wrap has been made thicker to increase the strength of a scroll wrap. To prevent the bulbous portion from coming into contact with the opposite wrap during operation, some of those scroll wraps have been provided with a slight relief as shown in the Japanese Patent Laid-Open Publication No. 60-252187, or U.S. Pat. Nos. 4,666,380 or 4,678,415.

As another method, there was a so-called wrap with trapezoid section, the shape of a section having large base width and small tip width throughout the wrap as shown in the Japanese Patent Laid-Open Publication No. 57-195801.

In these prior art constructions, no consideration was given to the performance though the strength was taken into consideration. Compressed gas finally collects at the winding-start portion of the wrap, which communicates with a discharge port to form a passage along which the gas flows out. Therefore, if the size of the passage is reduced due to too much emphasis being placed on the strength, the gas flowing through the passage encounters a large resistance and the compression line in the p-i diagram expands in the discharge stroke, resulting in a loss of the power. Provision of a slight relief which is large enough to prevent contact cannot solve this problem.

On the other hand, an ordinary conventional involute wrap known has a shape in which the winding-start portion is progressively thinned toward the inner periphery, that is, wedge-shaped. In this shape, a large stress due to gas pressure load occurs at the base of the wrap at the thinner inner peripheral end. According to this arrangement, although the strength is somewhat reduced, a sufficiently large passage area to the discharge port is obtained in the discharge stroke so that the flow resistance along the passage is advantageously reduced.

SUMMARY OF THE INVENTION

An object of the invention is to provide a scroll fluid machine having a wrap start portion with a thick base and a thin tip which can reduce the flow resistance by enlarging the area of the passage along which gas flows to a discharge port, without being accompanied by a reduction in the mechanical strength.

To achieve the above object, the invention proposes a scroll fluid machine in which superior mechanical strength offered by the bulbous wrap and superior performance offered by the web-type wrap are made compatible.

Since a large stress due to the gas pressure occurs when the base at the wrap winding-start portion is thin, it is necessary to make the base as thick as possible. When the thickness is maximized, a bulbous configuration is used which allows the wraps of the stationary and orbiting scroll members to be maintained to the end of the compression stroke until the internal clearance volume is reduced to zero.

Since, on the other hand, the nearer to the tip of the wrap, the smaller the stress, the tip portion adopts a wedge-shape composed of an involute curve which provides a large passage area and a concave arc.

For portions other than the winding-start portion, a conventional involute curve having the same shape at both the base and tip is used. A side wall is formed in such a way as to connect the curve of the base to that of the tip. Therefore, at the outer peripheral end of the wrap, a compression space is formed with an involute wrap with a constant thickness from the base to the tip as in the case of the conventional machine. The inner surface of the extreme inner periphery is so cone shaped that the passage area to the discharge port, having a sufficiently large area, is obtained.

DESCRIPTION OF THE PREFERRED EMBODIMENTS

Figure 1:
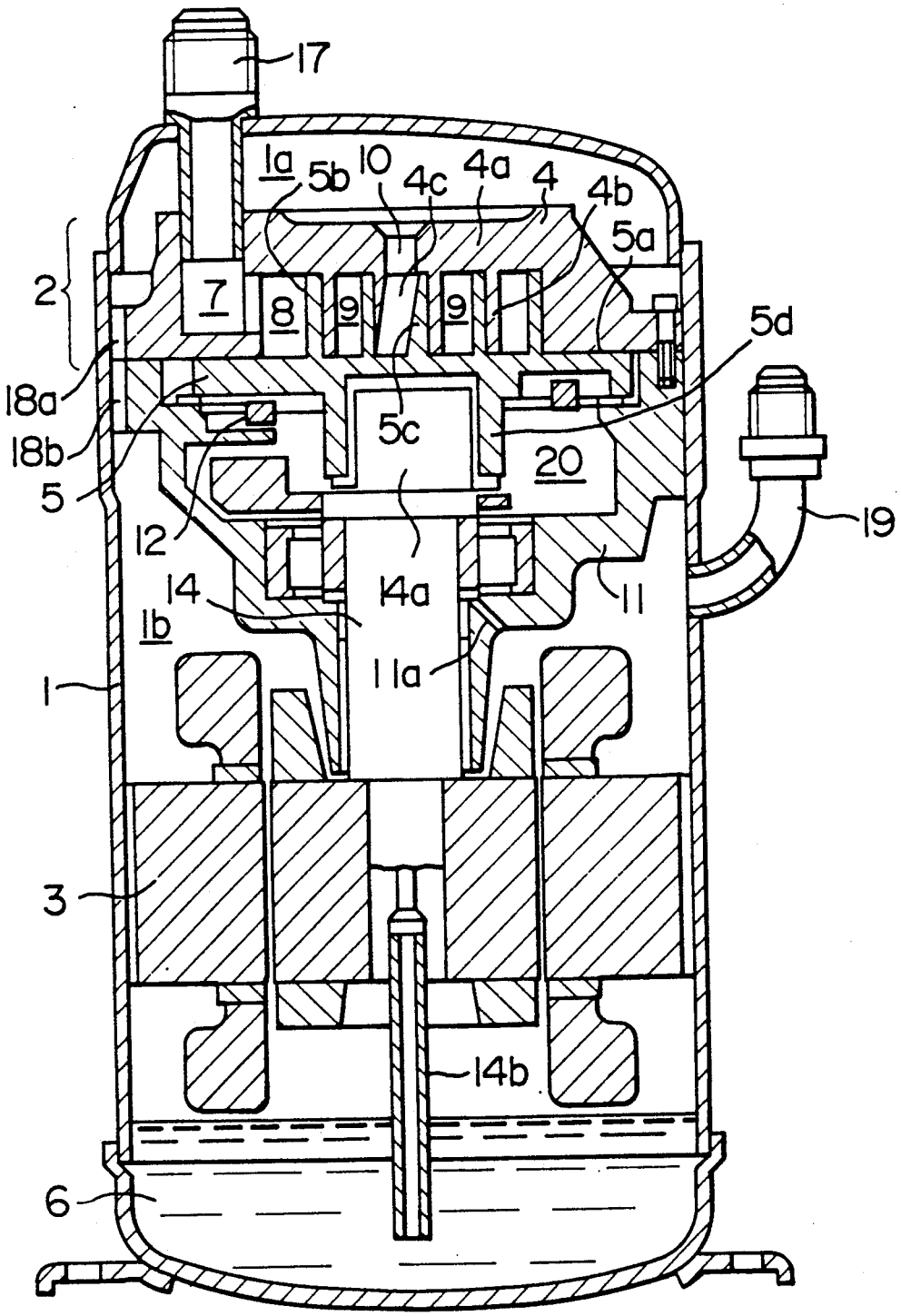
FIG. 1 is a vertical section of an entire scroll fluid machine constructed in accordance with the invention.
Figure 2:
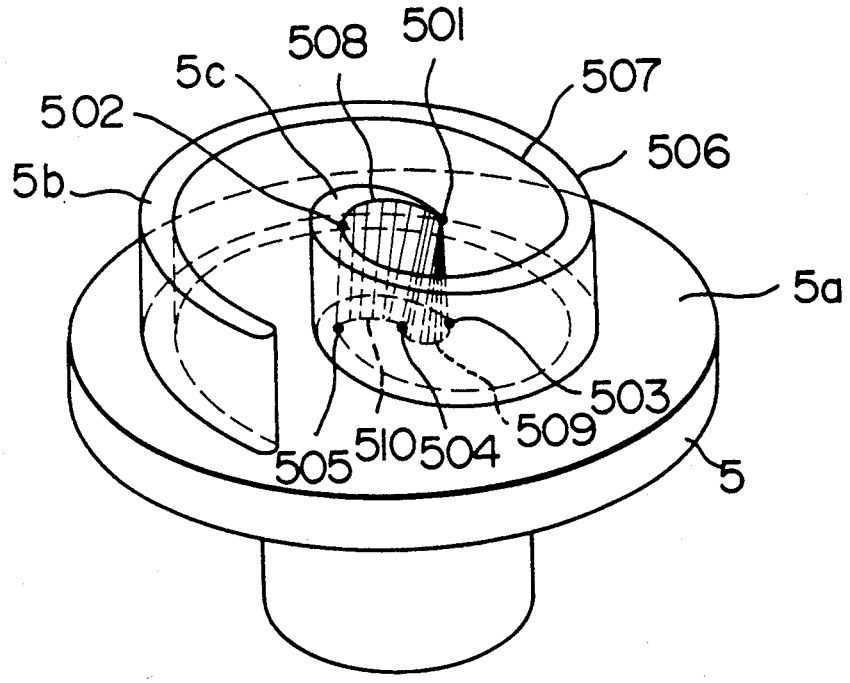
FIG. 2 is a perspective detail view of an orbiting scroll member constructed in accordance with the invention.

Referring to FIG. 1 to FIG. 3, a scroll compressors embodying the present invention has a compressor section 2 and a motor 3 which are accommodated within a hermetic shell 1. In the compressor section 2, a stationary scroll member 4 engages an orbiting scroll member 5 to form a compression chamber (closed space) 9. The stationary scroll member 4 includes a disk-shaped end plate 4*a* and a stationary scroll wrap 4*b* which perpendicularly protrudes from one side of the end plate 4*a* in the form of an involute curve or a curve approximating the same. The end plate 4*a* is provided with a discharge port 10 at a center thereof and with a suction port 7 at the periphery thereof. The orbiting scroll member 5 includes a disk-shaped end plate 5*a*, a wrap 5*b*, provided on the end plate 5*a* perpendicularly thereto and formed in the same shape as that of the stationary scroll wrap 4*b*, and a boss 5*d* formed on the surface of the end plate 5*a* opposite to the wrap 5*b*. A frame 11 is provided at its mid portion with a bearing portion 11*a* which rotatably supports a rotary shaft 14. An eccentric shaft 14*a*, provided at the end of the rotary shaft 14, is inserted rotatably into a boss 5*d*. The stationary scroll member 4 is secured to the frame 11 by a plurality of bolts, while the orbiting scroll member 5 is supported on the frame 11 by an Oldham's coupling mechanism consisting of an Oldham's coupling ring and an Oldham's coupling keys. The orbiting scroll member 5 is formed in such a way that it does not revolve on its axis, but rotates around the stationary scroll member 4. The rotary shaft 14 is directly connected to the motor 3 below the compressor section 2.

A suction tube 17 is connected to a suction port 7 in the stationary scroll member 4 though the wall of the hermetic shell 1. The discharge chamber 1*a*, apertured at the said discharge port 10, communicates with a lower chamber 1b through passages 18a and 18b, and further communicates with a discharge tube 19 through the wall of the hermetic shell 1.

In a space 20 (hereinafter called "back pressure chamber") defined between the back surface of the orbiting scroll member 5 and the frame 11, an intermediate pressure between the suction pressure (low pressure-side pressure) and discharge pressure acts so as to resist the gas pressure thrust (which is a reaction force thrusting the orbiting scroll member 5 downward) due to gas pressure in a plurality of compression chambers 9 formed by both the orbiting and stationary scroll members 4, 5. To set this intermediate pressure, an end plate 5a of the orbiting scroll member 5 is provided with a minute hole not shown), and gas compressed between the scroll members is led into the back pressure chamber 20 through this hole to act on the back surface of the orbiting scroll member 5.

An oil feed tube 14b is mounted in the rotary shaft 14 and the eccentric shaft 14a, with oil feeding passage holes (not shown) feeding oil to each bearing of the scroll compressor. The oil feed tube 14b projects from the lower end of the rotary shaft 14 up to the top end surface of the eccentric shaft 14a. The oil feed tube 14b is immersed in a pool of a lubricating oil 6 at the bottom of the hermetic shell 1.

In the scroll compressor having the above construction, the rotation of the rotary shaft 14 directly connected to the motor 3 causes the eccentric shaft 14a to revolve and drives the orbiting scroll member 5 through the boss 5d thereby causing the orbiting scroll member 5 to orbit. This orbiting movement causes the compression chamber 9 to gradually move to the center while reducing the volume of the compression chamber 9. A refrigerant gas at low temperature and low pressure enters from the suction tube 17 into a suction chamber 8 at the periphery within the stationary scroll 4 through the suction port 7. The refrigerant gas is compressed therein as described above to increase the pressure, and is then discharged into the discharge chamber 1a through the discharge port 10 at the center. This refrigerant gas at high temperature and high pressure enters the lower chamber 1b through the passages 18a and 18b, and is discharged outside through the discharge tube 19.

The wrap winding-start portion 4c of the stationary scroll member and a wrap winding-start portion 5c of the orbiting scroll member have, as illustrated, cross-sectional shapes in which the thickness is large at the base and small at the tip. A curve of an inside line at each base of the wraps is made as thick as possible while avoiding mutual interference between the wrap of the fixed scroll member and the wrap of the orbiting scroll member.

The detail of the winding-start portion 5c will be described with reference to FIG. 2 wherein an outside line 506, radially outside points 501 and 503 of the wrap 5b, and an inside line, radially outside points 502 and 505, are involute curves. The wrap base portion between the winding-start point 503 and the point 505 is composed of the following curve. A region between the point 503 and point 504 is composed of a convex arc 5-9. A radius r of the convex arc 509 is expressed by the following equation:

$$r = \frac{4a^2(\lambda_1^2 + 1) - \epsilon^2}{4(\epsilon + 2a\lambda_1)} \quad (1)$$

where a: radius of involute base circle, $\lambda_1$: winding-start angle, $\epsilon$: orbit radius.

Region between the point 504 and the point 505 is constituted by a concave arc 510. A radius R of the concave arc 510 is expressed by the following equation (2).

$$R = r + \epsilon \quad (2)$$

On the other hand, the region between the point 501 and the point 502 at the tip of the wrap is composed of an arc 508 the diameter of which substantially correspond to a distance between opposed walls of the involute curve of the wrap.

Figure 2A:
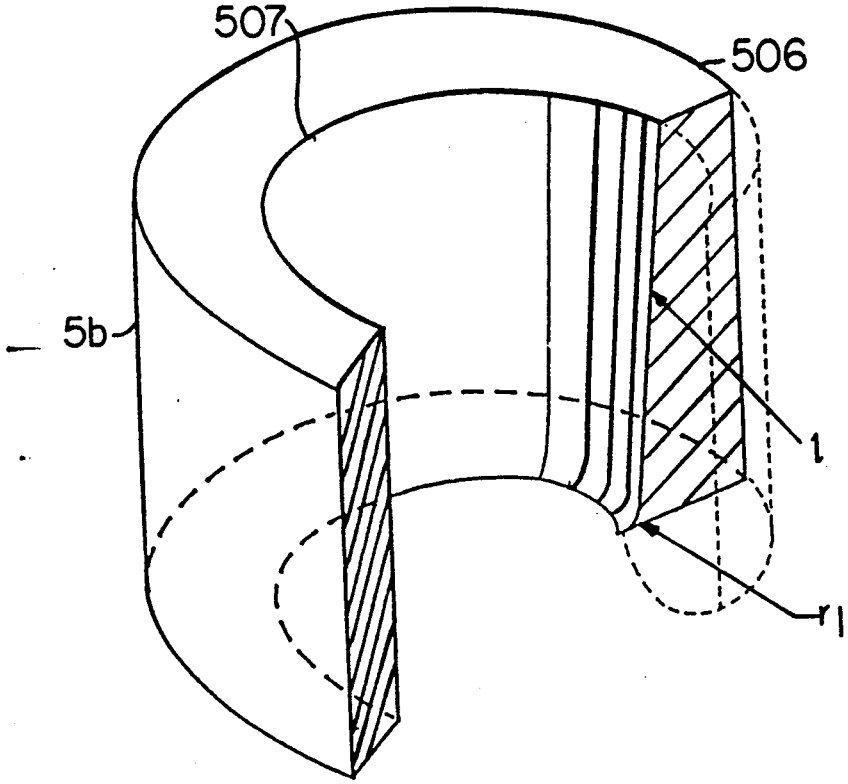
FIGS. 2A and 2B are enlarged partial cross-sectional detail views of the orbiting scroll member of FIG. 2 illustrating the configurations thereof.
Figure 2B:
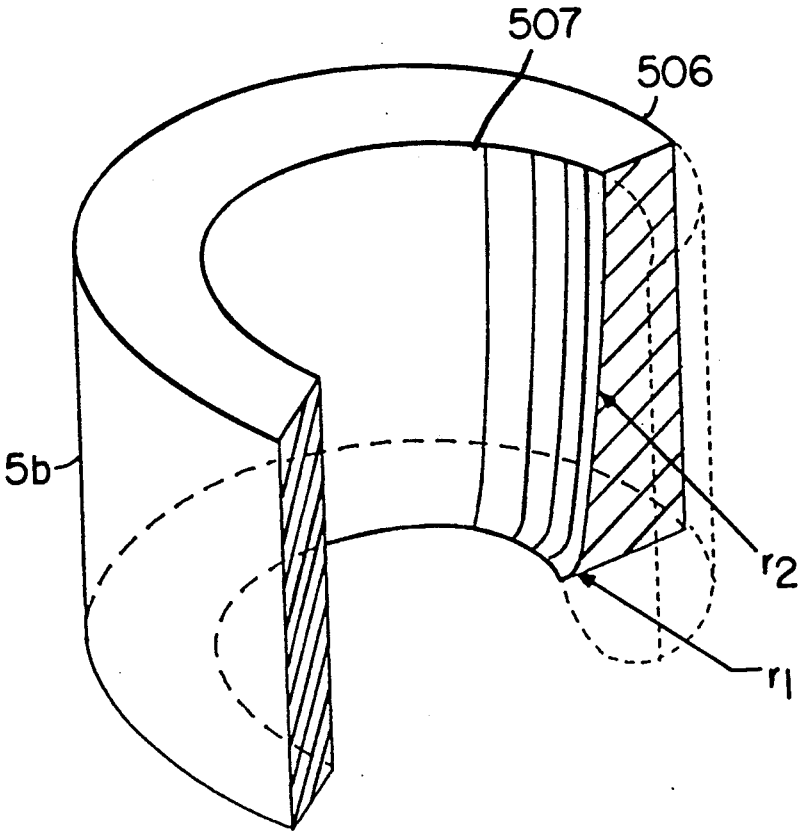

A curve of the base from the point 503 to 505 and a curve of the tip from the point 501 to 502 are connected through a smooth inclined wall W formed by joining a small arc $r_1$ with one of a large or gentle arc $r_2$ (FIG. 2B) or a straight line l (FIG. 2A) as viewed in cross section. The wrap 4b of the stationary scroll member 4 has also the same configuration as illustrated in FIGS. 2A and 2B.

Figure 3A:
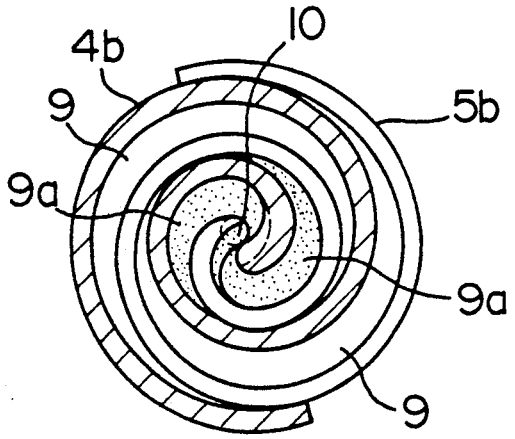
FIGS. 3*a*, 3*b*, 3*c* and 3*d* are operation diagrams illustrative of the compression and discharge strokes of a compressor embodying the present the invention.
Figure 3B:
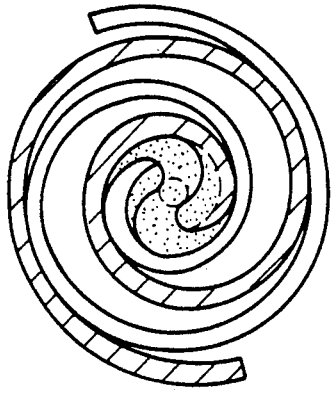
Figure 3C:
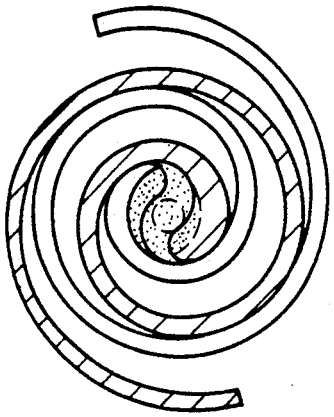
Figure 3D:
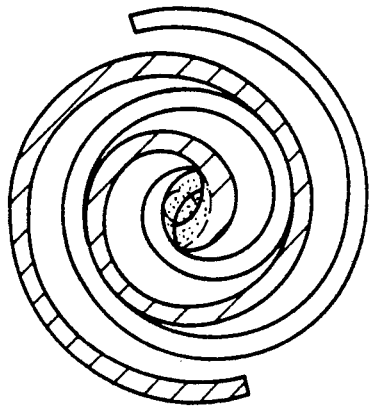

Referring to compression and discharge strokes of the compressor of this embodiment, FIG. 3a shows the compressor in a state when the suction stroke is complete and compression has just started. Thereafter, the strokes proceed in order as shown in FIGS. 3b, 3c and 3d, and the compression chamber 9 gradually moves towards the center while reducing its volume. Consequently, the gas is discharged through the discharge port 10. Since the passage for gas is allowed to have a wide area as shown by the dotted area in the figures at the end of the compression stroke the fluid resistance and, hence, the power loss are correspondingly small, thus offering superior performance of the compressor. Moreover, the base of the wrap having bulbous configuration offers a superior strength of the compressor.

The wall surface between the point 501 and 502 has nothing to do with the compression action, and requires no dimensional accuracy. Therefore, this portion may remain as-forged or as-cast, without requiring any machining.

As mentioned above, the present invention employs the bulbous base form at the wrap winding-start portion where the bending moment due to gas pressure load is largest, whereby the stress is reduced to offer a high wrap strength. Therefore, the durability of the compressor is improved.

At the same time, the tip of the wrap at the wrap winding-start portion is formed in the wedge shape to offer a large passage area which reduces the fluid resistance, and so the compressor with high performance can be obtained.

While the invention has been particularly shown and described with reference to preferred embodiments thereof, it will be understood by those skilled in the art that the foregoing and other changes in form and details ca be made therein without departing from the spirit and scope of the invention.

What is claimed is:

1. A scroll fluid machine comprising a stationary scroll member and an orbiting scroll member each having an end plate and an involute wrap provided on said end plate perpendicularly thereto, said scroll members engaging with each other with said involute wraps meshing with each other, said orbiting scroll member being provided for revolving about its own axis, but being allowed to rotate around said stationary scroll member so as to compress and discharge a gas, a winding-start portion of each of said wraps has such a sectional shape that a base thereof is thick and a tip thereof is thin, wherein:

a curve of an inside line at said base of each of said wraps is such that said base is made as thick as possible while avoiding mutual interference between said wrap of said fixed scroll member and said wrap of said orbiting scroll member, a curve of an inside line at said tip of each of said wraps has such a shape that the thickness of the tip is gradually thinned toward an inner peripheral end thereof, and a section of each of said wraps in a wrap axial direction has such a shape that the thickness of the wrap is gradually reduced from said base toward said tip.

2. A scroll fluid machine comprising a stationary scroll member and an orbiting scroll member, each having an end plate and an involute wrap provided on said end plate perpendicularly thereto, each of said wraps meshing with each other in an inner side thereof, said stationary scroll member being supported on a frame, said orbiting scroll member engaging an eccentric shaft portion supported on said frame and mounted on a rotary shaft, said orbiting scroll member not being allowed to revolve on its own axis, but to rotate around an axis of said stationary scroll member, and said stationary scroll member is provided with a discharge port at a center thereof and with a suction port at an outer periphery thereof so that a gas is suctioned through said suction port and compressed by allowing an enclosed chamber formed by said stationary and orbiting scroll members to move toward the center while reducing the volume thereof and the compressed gas is discharged through said discharge port, wherein a windingstart portion of each of said wraps is formed to have a sectional shape such that a base thereof is thick and a tip thereof is thin, wherein:

a curve at said base of each of said wraps at said winding-start portion is formed with an outside line of an involute curve and with an inside line of an involute curve, an arc with a radius r, and an arc with a radius R, a curve of an inside line at the tip of each of said wraps has a shape such that a thickness of said tip is gradually thinned toward an inner peripheral end thereof, and each of said wraps has an axial sectional shape such that the shape gradually becomes less from said base toward said tip, and said radius r is substantially represented by:

$$r = \frac{4a^2(\mu^2 + 1) - \epsilon^2}{4(\epsilon + 2a\mu_1)},$$

where:

a=an involute base radius of said wraps, $\mu_1$=a winding-start angle, and $\epsilon$=orbiting-radius, and wherein said radius R is substantially represented by:

$$R=r+\epsilon.$$

3. The scroll fluid machine of claim 2, wherein said curve of the inside line at said tip of said wrap includes an arc with a diameter almost equal to a distance between opposed walls of the involute wrap.

4. The scroll fluid machine of claim 3, wherein said base of an inner wall of said wraps and said end plate are connected with a small arc, and said small arc and said tip are connected with one of a straight line and a gentle arc in an axial section of said wrap.

* * * * *